US009878562B2

(12) United States Patent
Ueyama et al.

(10) Patent No.: US 9,878,562 B2
(45) Date of Patent: Jan. 30, 2018

(54) PRINTING APPARATUS

(71) Applicant: SEIKO EPSON CORPORATION, Tokyo (JP)

(72) Inventors: Naohiro Ueyama, Matsumoto (JP); Naoto Hayakawa, Shiojiri (JP); Akira Ishikawa, Shiojiri (JP); Daiki Ishikawa, Shiojiri (JP); Yuta Kawaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/465,753

(22) Filed: Mar. 22, 2017

(65) Prior Publication Data

US 2017/0291433 A1 Oct. 12, 2017

(30) Foreign Application Priority Data

Apr. 8, 2016 (JP) ..... 2016-077877

(51) Int. Cl.
*B41J 11/02* (2006.01)

(52) U.S. Cl.
CPC ..... *B41J 11/02* (2013.01)

(58) Field of Classification Search
CPC .... B41J 13/106; B41J 13/103; B41J 13/0054; B41J 11/006; B41J 11/0065; B41J 11/007; B41J 11/02; G01S 7/04
See application file for complete search history.

(56) References Cited

U.S. PATENT DOCUMENTS

2003/0049043 A1* 3/2003 Fuwazaki ..... B41J 13/02 399/98
2015/0124034 A1* 5/2015 Shinoda ..... B41J 3/4078 347/104
2016/0023490 A1* 1/2016 Sato ..... B41J 29/12 347/101

FOREIGN PATENT DOCUMENTS

JP 10-265075 A 10/1998
WO 2017145674 A 8/2017

* cited by examiner

*Primary Examiner* — Kristal Feggins
(74) *Attorney, Agent, or Firm* — Workman Nydegger

(57) ABSTRACT

A printing apparatus includes a printing portion, a transport portion a medium support portion disposed on an upstream side of a recording head, and a removal portion that includes a first contact portion, which comes into contact with the printing surface when a medium is supported by the medium support portion. The removal portion is spatially separated from the medium support portion at both a section on the upstream side of the first contact portion and a section on the downstream side of the first contact portion. An interval between the removal portion and the medium support portion becomes wider in tandem with progression toward a direction opposite to the transport direction on the upstream side in the transport direction of the first contact portion, and becomes wider in tandem with progression toward the transport direction on the downstream side in the transport direction of the first contact portion.

10 Claims, 10 Drawing Sheets

PRINTING APPARATUS

BACKGROUND

1. Technical Field

The present invention relates to a printing apparatus.

2. Related Art

An ink jet type printer, which is an example of a printing apparatus, is provided with a transport portion that transports a medium, and a recording head, which includes a nozzle formation surface that discharges an ink, and prints a desired image on the medium by alternately repeating an operation that discharges the ink from the nozzle formation surface while moving the recording head in a direction that intersects a transport direction, and an operation that transports the medium in the transport direction. In addition, in a section that prints an image, since the nozzle formation surface is disposed in proximity to the medium in order to cause discharged ink to land accurately in a predetermined position, it is likely that the nozzle formation surface will be stained by foreign matter adhered to the medium.

A printing apparatus is used in an environment in which foreign matter such as dust, fluff, or the like, is present. Therefore, it is likely that the foreign matter due to environmental factors will become adhered to the medium and be taken inside the printing apparatus. If foreign matter is taken into a section that prints an image, there is a concern that the nozzle formation surface will be stained by the foreign matter, that the ink discharge performance of the recording head will change, and therefore, that there will be a decrease in the printing quality of an image.

For example, the printer (printing apparatus) disclosed in JP-A-10-265075 includes a dust removal member for removing dust, and suppresses the adverse effects of foreign matter by removing dust (foreign matter) adhered to a roller by using the dust removal member. To explain in more detail, the dust removal member is a brush, and removes foreign matter by scraping away foreign matter adhered to the roller by using the brush.

However, in the printing apparatus disclosed in JP-A-10-265075, there is a concern that foreign matter scraped away by the brush will be scattered at the periphery, become adhered to the medium, or the like, and cause staining of the nozzle formation surface. Furthermore, since a configuration that removes the foreign matter adhered to the medium due to environmental factors is not included, there is a concern that foreign matter adhered to the medium due to environmental factors will stain the nozzle formation surface, that the ink discharge performance of the recording head will change, and therefore, that there will be a decrease in the printing quality of an image.

SUMMARY

The invention can be realized as the following aspects or application examples.

Application Example 1

According to this application example, there is provided a printing apparatus including a printing portion that performs printing on a printing surface of a medium, a transport portion that transports the medium in a transport direction and feeds out the medium to the printing portion, a medium support portion that is disposed on an upstream side in the transport direction with respect to the printing portion and, among surfaces of the medium, supports a surface on a side opposite to the printing surface, and a removal portion that has a flexible property and includes a first contact portion, which comes into contact with the printing surface in a case in which the medium is supported by the medium support portion, in which the removal portion is spatially separated from the medium support portion at both a section further on the upstream side in the transport direction than the first contact portion and a section further on the downstream side in the transport direction than the first contact portion, and an interval between the removal portion and the medium support portion becomes wider in tandem with progression toward a direction opposite to the transport direction on the upstream side in the transport direction of the first contact portion, and becomes wider in tandem with progression toward the transport direction on the downstream side in the transport direction of the first contact portion.

Since the removal portion is provided so as to come into contact with the printing surface of the medium on the upstream side in the transport direction with respect to the transport portion, foreign matter adhered to the printing surface of the medium is removed on the upstream side in the transport direction with respect to the transport portion, take-in (entering) of foreign matter into the transport portion or the printing portion is suppressed, and therefore, it is possible to suppress a decrease in printing performance (a decrease in the printing quality of an image) due to foreign matter.

Furthermore, since the interval between the removal portion and the medium support portion becomes wider in tandem with progression toward a direction opposite to the transport direction on the upstream side in the transport direction of the first contact portion, in a case in which the medium is transported in the transport direction, since it is possible to receive the medium in a section in which the interval between the removal portion and the medium support portion is wide, it is more likely that the medium will be transported between the removal portion and the medium support portion than in a case in which the medium is received in a section in which the interval between the removal portion and the medium support portion is narrow, and therefore, it is unlikely that transport of the medium will be blocked.

Since the interval between the removal portion and the medium support portion becomes wider in tandem with progression toward the transport direction on the downstream side in the transport direction of the first contact portion, in a case in which the medium is transported in the direction opposite to the transport direction, it is possible to receive the medium in a section in which the interval between the removal portion and the medium support portion is wide, it is more likely that the medium will be transported between the removal portion and the medium support portion than in a case in which the medium is received in a section in which the interval between the removal portion and the medium support portion is narrow, and therefore, it is unlikely that transport of the medium will be blocked.

Application Example 2

In the printing apparatus according to the application example, it is preferable that the first contact portion extend in a direction that intersects the transport direction.

The direction that intersects the transport direction is a width direction of the medium, and the transport direction is a length direction of the medium.

When the first contact portion extends in the direction that intersects the transport direction, it is possible for the removal portion to come into contact with the printing surface of the medium over a wide range in the width direction of the medium. Furthermore, when the medium is transported in the transport direction, it is possible for the removal portion to remove foreign matter adhered to the printing surface of the medium, in the length direction of the medium over a wide range in the width direction of the medium.

Application Example 3

It is preferable that the printing apparatus according to the application example further include a fixing portion that fixes the removal portion, and that, in a case in which the medium is not supported by the medium support portion, the removal portion block a gap between the fixing portion and the medium support portion by coming into contact with the medium support portion.

Since the interval between the fixing portion and the medium support portion is blocked by the removal portion, it is possible to suppress a concern that the transport portion or the printing portion will be stained by foreign matter as a result of airborne foreign matter entering from the interval between the fixing portion and the medium support portion.

Application Example 4

In the printing apparatus according to the application example, it is preferable that a length in the transport direction of the first contact portion be greater than a length in the transport direction of a second contact portion in a case in which a section in which the removal portion comes into contact with the medium support portion is set as the second contact portion in a case in which the medium is not supported by the medium support portion.

When the first contact portion is long in the transport direction, a force that removes foreign matter acts on the printing surface of the medium from the first contact portion for longer than in a case in which the first contact portion is short in the transport direction, and therefore, it is possible to more forcibly remove foreign matter adhered to the printing surface of the medium. Accordingly, it is preferable that the length in the transport direction of the first contact portion be greater than the length in the transport direction of the second contact portion.

Application Example 5

In the printing apparatus according to the application example, it is preferable that the removal portion be divided into a plurality in a direction that intersects the transport direction.

In a case in which the removal portion is deteriorated due to staining, scuffing, and the like, since it is sufficient to replace a portion (a deteriorated removal portion) from among the removal portions divided into a plurality, it is possible to suppress maintenance costs of the removal portion in comparison with a case in which the entire removal portion is replaced.

Application Example 6

In the printing apparatus according to the application example, it is preferable that the removal portion include a first member that is disposed on a side of the medium support portion, and a second member that is disposed on a side opposite to the medium support portion, and that the rigidity of the second member be greater than that of the first member.

When the rigidity of the removal portion (the first member) is enhanced by disposing the second member, the removal portion (the first member) presses the printing surface of the medium more firmly in the first contact portion than in a case in which the rigidity of the removal portion (the first member) is not enhanced, and therefore, it is possible to forcibly remove foreign matter adhered to the printing surface of the medium.

Application Example 7

It is preferable that the printing apparatus according to the application example further include a fixing portion that fixes the removal portion, that the removal portion include one end that is fixed to the fixing portion, and another end that is fixed to the fixing portion, and that the one end and the other end be separated from one another.

When the removal portion is disposed on the upstream side in a gravity direction with respect to the medium support portion in a state in which the one end and the other end are separated from one another, the removal portion is displaced in the gravity direction between the one end and the other end, comes into contact with the printing surface of the medium supported by the medium support portion, and is spatially separated from the medium support portion in accordance with approach toward the one end or the other end from a section that is in contact with the printing surface.

That is, the removal portion is spatially separated from the medium support portion in both a section further on the upstream side in the transport direction than the first contact portion and a section further on the downstream side in the transport direction than the first contact portion, and therefore, it is possible to stably form a shape in which the interval between the removal portion and the medium support portion becomes wider in tandem with progression toward a direction opposite to the transport direction on the upstream side in the transport direction of the first contact portion and becomes wider in tandem with progression toward the transport direction on the downstream side in the transport direction of the first contact portion.

Application Example 8

In the printing apparatus according to the application example, it is preferable that the removal portion be configured by a conductive member.

When the removal portion has a conductive property, it is possible to neutralize a charge (for example, static electricity) accumulated on the medium. For example, when foreign matter becomes adhered to the medium due to an electrostatic force, the electrostatic force that causes the foreign matter to adhere to the medium is weakened by neutralizing the charge of medium by using the removal portion, and therefore, it is likely that foreign matter will be removed from the printing surface of the medium.

Application Example 9

In the printing apparatus according to the application example, it is preferable that the transport portion include a plurality of rollers, and that the removal portion be disposed further on the upstream side in the transport direction than a roller disposed furthest on the upstream side in the transport direction among the plurality of rollers.

Since the removal portion is disposed further on the upstream side in the transport direction than the roller disposed furthest on the upstream side in the transport direction among the plurality of rollers, foreign matter adhered to the printing surface of the medium is removed by the removal portion, and therefore, it is unlikely that the plurality of rollers will be stained. Accordingly, it is possible to suppress the concern that foreign matter will become adhered to the rollers, the foreign matter will become adhered to the printing surface of the medium again via the rollers, the printing portion will be stained and that this will lead to a decrease in printing quality.

Application Example 10

It is preferable that the printing apparatus according to the application example further include a setting portion that feeds out the medium to the transport portion, and that the removal portion be disposed between the setting portion and the transport portion.

Foreign matter adhered to the printing surface of a medium fed out from the setting portion is removed by the removal portion, which is disposed between the setting portion and the transport portion, and therefore, it is difficult for the transport portion and the printing portion, which are provided on the downstream side in the transport direction with respect to the removal portion to become stained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
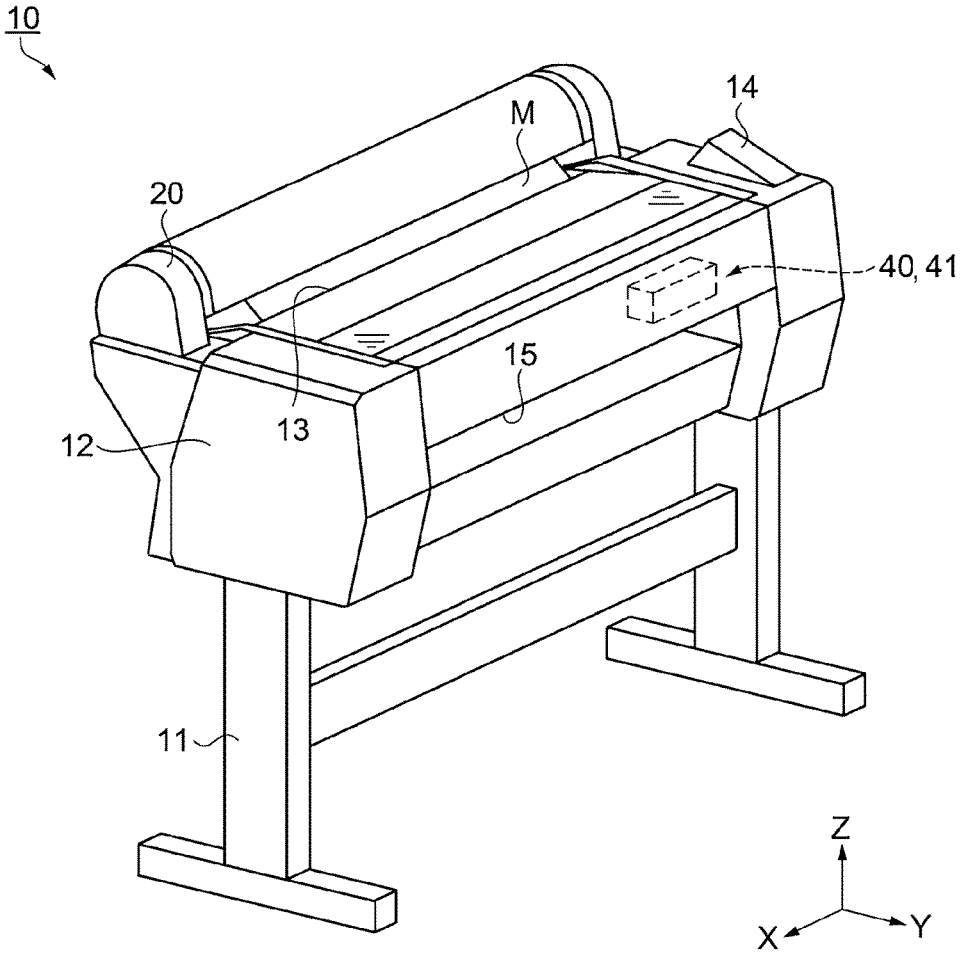
FIG. 1 is a perspective view of a printing apparatus according to Embodiment 1.

Hereinafter, embodiments of the invention will be described with reference to the drawings. The embodiments illustrate aspects of the invention, but do not limit the invention, and can be changed arbitrarily within a range of the technical idea of the invention. In addition, in each of the drawings below, the scales are altered for each layer and each location in order to make each layer and each location have a size that is easy to understand in the drawings.

Embodiment 1

Summary of Printing Apparatus

Figure 2:
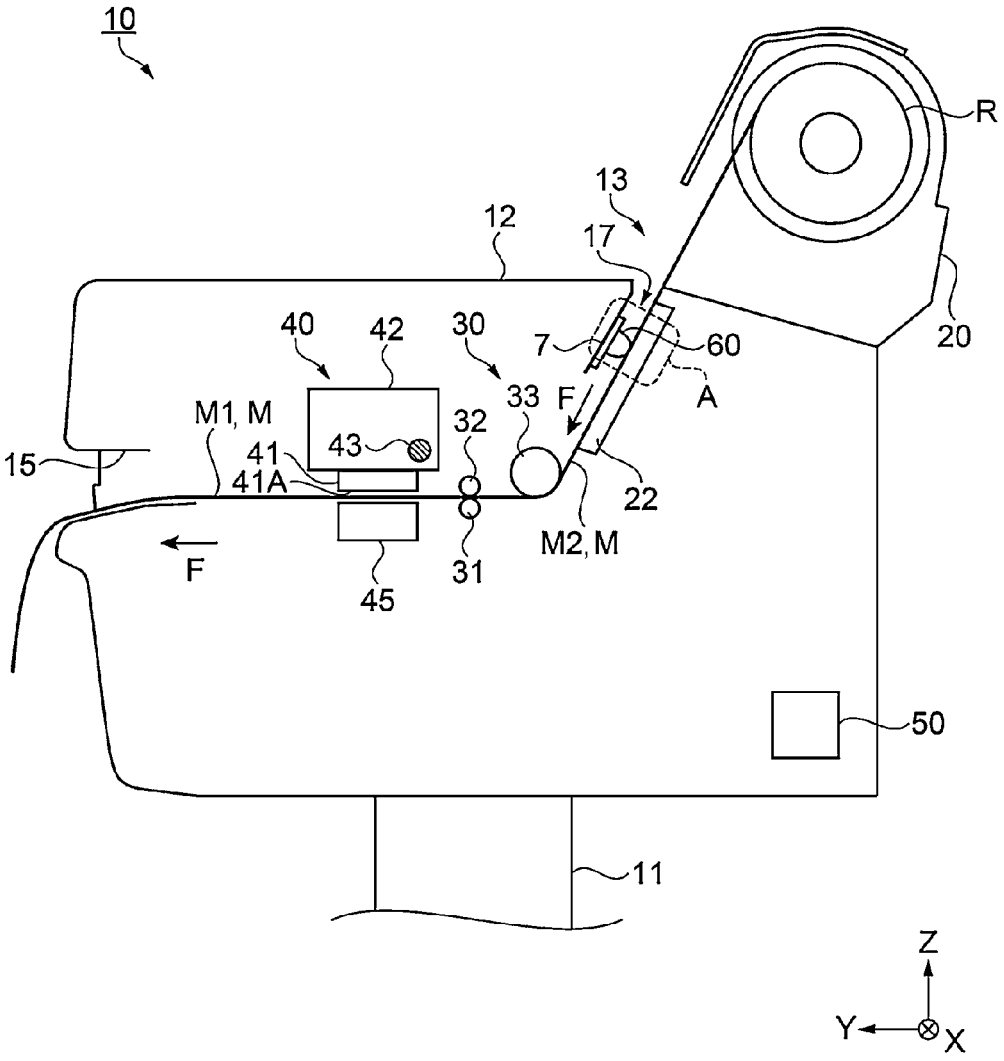
FIG. 2 is a schematic view that shows a configuration of the printing apparatus according to Embodiment 1.

FIG. 1 is a perspective view of a printing apparatus according to Embodiment 1. FIG. 2 is a schematic diagram that shows a configuration of a printing apparatus according to the present embodiment.

Firstly, a summary of a printing apparatus 10 will be described with reference to FIGS. 1 and 2.

As shown in FIG. 1, the printing apparatus 10 of the present embodiment is a large format printer (LFP) that handles a longitudinal medium M (sheet of paper). The printing apparatus 10 is provided with a pair of leg portions 11, a substantially rectangular parallelepiped form housing portion 12 that is supported by the leg portions 11, and a setting portion 20 that feeds out (feeds) the medium M to the housing portion 12.

In the description from this point onwards, the longitudinal direction of the housing portion 12 (the width direction of the medium M) will be set as an X direction, the lateral direction of the housing portion 12 will be set as a Y direction, and a direction (the gravity direction) orthogonal to X direction and the Y direction will be set as a Z direction. Furthermore, tip end sides of the arrows that show the directions in the drawings, are set as "(+) directions", and base end sides thereof are set as "(−) directions".

The setting portion 20 is provided so as to protrude upward (in a Z (+) direction) from the back surface (the surface on a Y (−) direction side) of the housing portion 12. A roll body R (refer to FIG. 2), in which the medium M is wound up in cylindrical form (roll form) is accommodated in the setting portion 20. In addition, a plurality of sizes of the rolled body R in which the width (the length in the X direction) and the winding number of the medium M differ can be loaded into the setting portion 20 in an exchangeable manner. The medium M is reeled out from the roll body R and is supplied to the printing region 40 inside the housing portion 12 as a result of the roll body R being driven in a rotational manner by a driving motor (not illustrated in the drawings). A recording head 41, which is an example of a "printing portion", is provided in the printing region 40. In this manner, the printing apparatus 10 includes the setting portion 20, which feeds out the medium M to the printing region 40.

For example, the medium M is configured by a fabric such as a polyester, a paper, a film, or the like. Furthermore, the medium M need not necessarily be rolled paper and may be single sheet paper.

The housing portion 12 includes a feeding port 13, an ejection port 15, a manipulation portion 14, and the like. The feeding port 13 is provided in a back surface upper portion of the housing portion 12. The manipulation portion 14 is an upper portion of the housing portion 12, and is provided on a right end (an end on the X (−) direction side) in the longitudinal direction of the housing portion 12. Various settings for causing an image, or the like, to be printed on the medium M are input from the manipulation portion 14 by a user. The ejection port 15 is provided on the front surface of the housing portion 12.

As shown in FIG. 2, the medium M is reeled out from the roll body R that is accommodated in the setting portion 20, is fed to the inner portion of the housing portion 12 from the feeding port 13, and is ejected to the outer portion of the housing portion 12 from the ejection port 15 after printing is performed thereon in the printing region 40.

The housing portion 12 includes a section that is folded over in the inner portion thereof close to the feeding port 13. A fixing portion 7 is fixed to the folded over section of the housing portion 12 in a detachable manner.

A transport portion 30 that transports the medium M in a transport direction F, a printing region 40, a control portion 50 that controls the actions of the transport portion 30 and the printing region 40, a medium support portion 22, and a removal portion 60 are provided in the inner portion of the housing portion 12.

The setting portion 20 feeds out the medium M to the transport portion 30.

The transport portion 30 transports the medium M in the transport direction F, and feeds out the medium M to the printing region 40 (the recording head 41). The transport portion 30 is positioned further on the upstream side in the transport direction F than the printing region 40 (the recording head 41), and includes a plurality of rollers 31, 32, and 33 (a driving roller 31, a driven roller 32, and a guide roller 33).

The guide roller 33 is positioned furthest on the upstream side in the transport direction F among the rollers 31, 32, and 33 in the transport portion 30, and guides the medium M fed out from the setting portion 20 to the printing region 40. The driven roller 32 is driven to rotate as a result of being brought into a pressing contact with the driving roller 31 via the medium M. The driving roller 31 holds the medium M between itself and the driven roller 32. The medium M is transported in the transport direction F as a result of the driving roller 31 being driven in a rotational manner by a driving motor (not illustrated in the drawings).

The recording head 41, a carriage 42 that holds the recording head 41, a platen 45 that supports the medium M, and a guide shaft 43 that supports the carriage 42 are did in the printing region 40.

The recording head 41 prints images on a printing surface M1 of the medium M by discharging an ink. In other words, the recording head 41 functions as a printing portion that performs printing on the printing surface M1 of the medium M. Additionally, it is sufficient as long as the printing portion performs the printing of images on the medium M, and may have a configuration that transfers images to the medium M.

The recording head 41 includes a nozzle formation surface 41A, in which a plurality of nozzles (not illustrated in the drawings), and discharges the ink onto the printing surface M1 of the medium M. The carriage 42, which holds the recording head 41, reciprocates in a width direction (the X direction) of the medium M as a result of the motive power of the driving motor (not illustrated in the drawings). The platen 45 is provided with a substantially rectangular surface, in which the width direction of the medium M is set as a longitudinal direction, on the upper surface thereof, which faces the recording head 41. A surface M2 on a side opposite to the printing surface M1 of the medium M is supported using suction on the upper surface of the platen 45 as a result of a negative pressure applied to the platen 45. As a result of this, a decrease in printing quality due to lifting of the medium M is prevented.

In the printing apparatus 10, predetermined images are formed (printed) by aligning rows of a plurality of dots (raster lines) on the printing surface M1 of the medium M in the Y direction as a result of alternately repeating an operation that discharges the ink onto the printing surface M1 of the medium M from the recording head 41 while causing the carriage 42 to reciprocate in the X direction, and an operation in which the transport portion 30 transports the medium M in the transport direction F (the Y direction).

Additionally, in the present embodiment, a serial head type recording head, which is mounted in the reciprocating carriage 42, and discharges the ink while moving in the width direction (the X direction) of the medium M, is illustrated as the recording head 41 by way of example, but a line head type recording head that is fixedly arranged extending in the width direction (the X direction) of the medium M may also be used.

The medium support portion 22 is provided between the guide roller 33 (the transport portion 30) and the setting portion 20, and is disposed so as to face the fixing portion 7. That is, the medium support portion 22 is disposed on the upstream side in the transport direction F with respect to the recording head 41 and supports the surface M2 on the side opposite to the printing surface M1 of the medium M.

The medium M unwound from the roll body R passes through a gap 17 between the medium support portion 22 and the fixing portion 7, and is fed out to the transport portion 30.

The removal portion 60 is fixed to the fixing portion 7. To explain in more detail, the removal portion 60 is adhered (fixed) to the fixing portion 7 via an adhesive sheet. Additionally, for example, the removal portion 60 may be fixed to the fixing portion 7 by using an adhesive, or, for example, may be fixed to the fixing portion 7 using a member such as a screw, or the like.

The removal portion 60 is disposed between the setting portion 20 and the transport portion 30, and is provided on the upstream side in the transport direction F with respect to the transport portion 30. That is, the removal portion 60 is positioned further on the upstream side in the transport direction F than the guide roller 33, which is positioned furthest on the upstream side in the transport direction F among the plurality of rollers 31, 32, and 33. The removal portion 60 has a flexible property, and is disposed so as to come into contact with the medium M or the medium support portion 22. In addition, in a case in which the medium M is not supported by the medium support portion 22, the removal portion 60 is disposed so as to block the gap 17 between the medium support portion 22 and the fixing portion 7.

In the above-mentioned manner, a plurality of sizes of the rolled body R in which the width and the winding number of the medium M differ can be loaded into the setting portion 20 in an exchangeable manner. A user loads a required roll body R in the setting portion 20 by handling the roll body R. As a result of this handling work, foreign matter such as fluff or dust becomes adhered to the medium M. Further, there is a concern that foreign matter adhered to the medium M will be taken into the printing region 40, and become adhered to the nozzle formation surface 41A of the recording head 41.

Furthermore, there is a concern that foreign matter such as dust or fluff will become adhered to the nozzle formation surface 41A of the recording head 41 as a result of becoming airborne, entering the inner portion of the housing portion 12 from the gap 17 between the medium support portion 22 and the fixing portion 7, and being taken into the printing region 40.

If a portion of the nozzles are obstructed as a result of foreign matter becoming adhered to the nozzle formation surface 41A of the recording head 41, defects such as the ink not being discharged uniformly from the plurality of nozzles provided in the nozzle formation surface 41A can occur. For example, defects such as printing irregularities may occur as a result of the contrast differing between a raster line formed by nozzles obstructed by foreign matter and a raster line formed by nozzles that are not obstructed by foreign matter.

In the present embodiment, in a case in which the medium M is fed out from the setting portion 20, the removal portion 60 removes foreign matter adhered to the printing surface M1 of the medium M as a result of coming into contact with the printing surface M1 of the medium M. Accordingly, it is unlikely that foreign matter adhered to the medium M will be taken into the printing region 40, and therefore, it is unlikely that a printing defect caused by the above-mentioned foreign matter will occur.

In the present embodiment, in a case in which the medium M is not fed out from the setting portion 20, the removal portion 60 blocks the gap 17 between the medium support portion 22 and the fixing portion 7 as a result of coming into contact with the medium support portion 22, and therefore, it is unlikely that airborne foreign matter will enter the inner portion of the housing portion 12. Accordingly, it is unlikely that airborne foreign matter will enter the printing region 40, and therefore, it is unlikely that a printing defect caused by the above-mentioned foreign matter will occur.

Summary of Removal Portion

Figure 3:
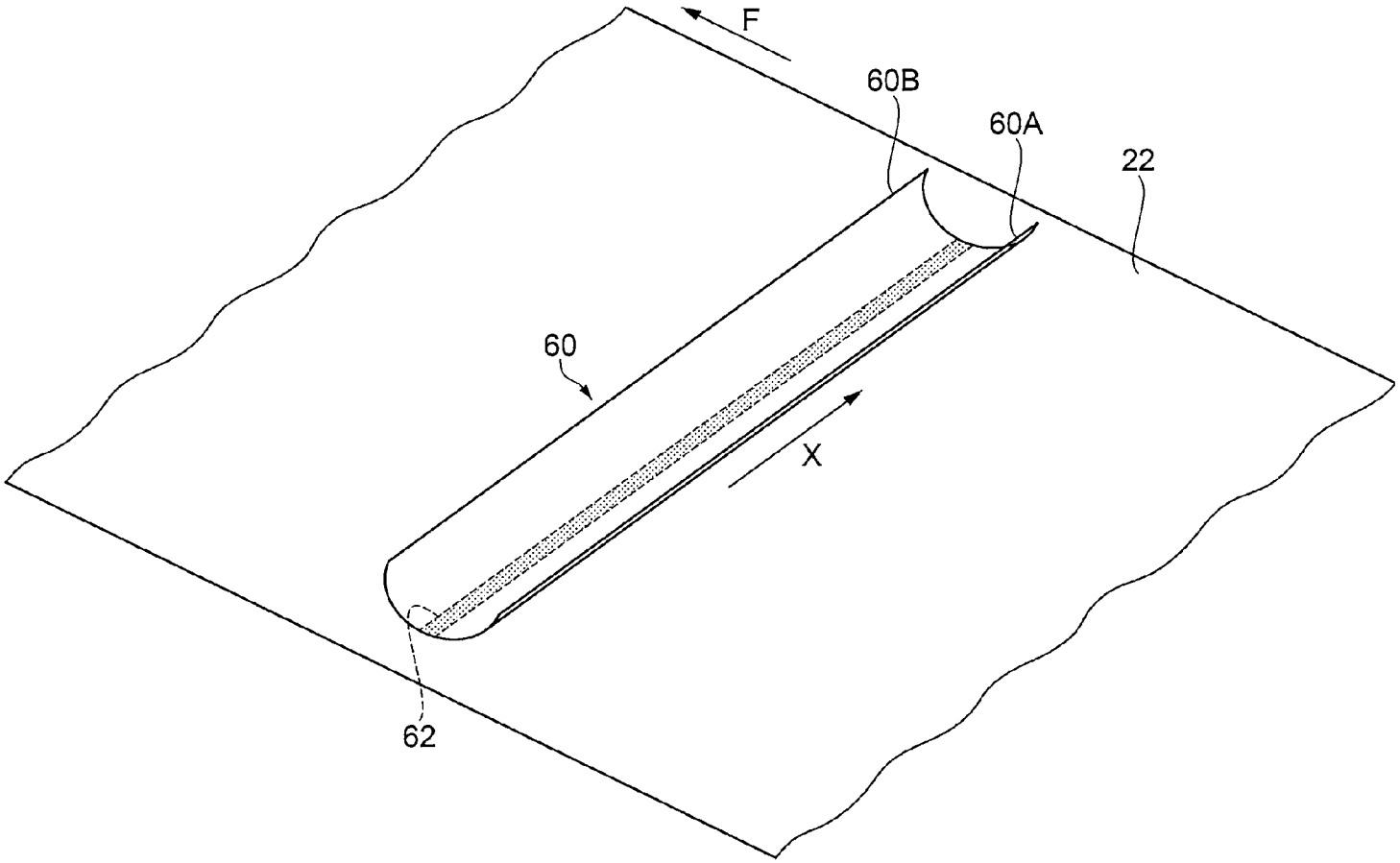
FIG. 3 is a schematic view that shows a state of a removal portion viewed in an oblique direction.
Figure 4:
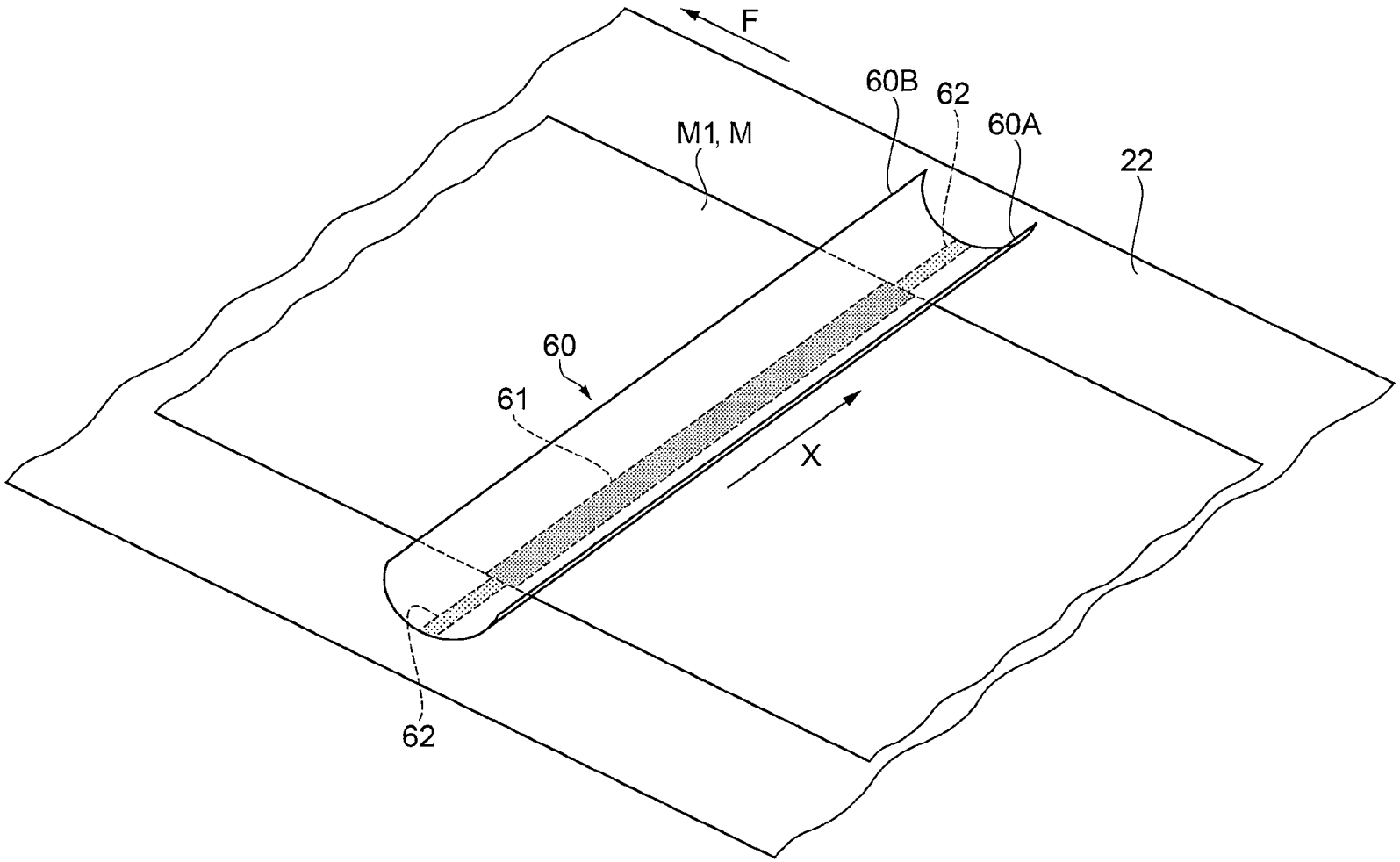
FIG. 4 is a schematic view that shows a state of the removal portion viewed in the oblique direction.
Figure 5:
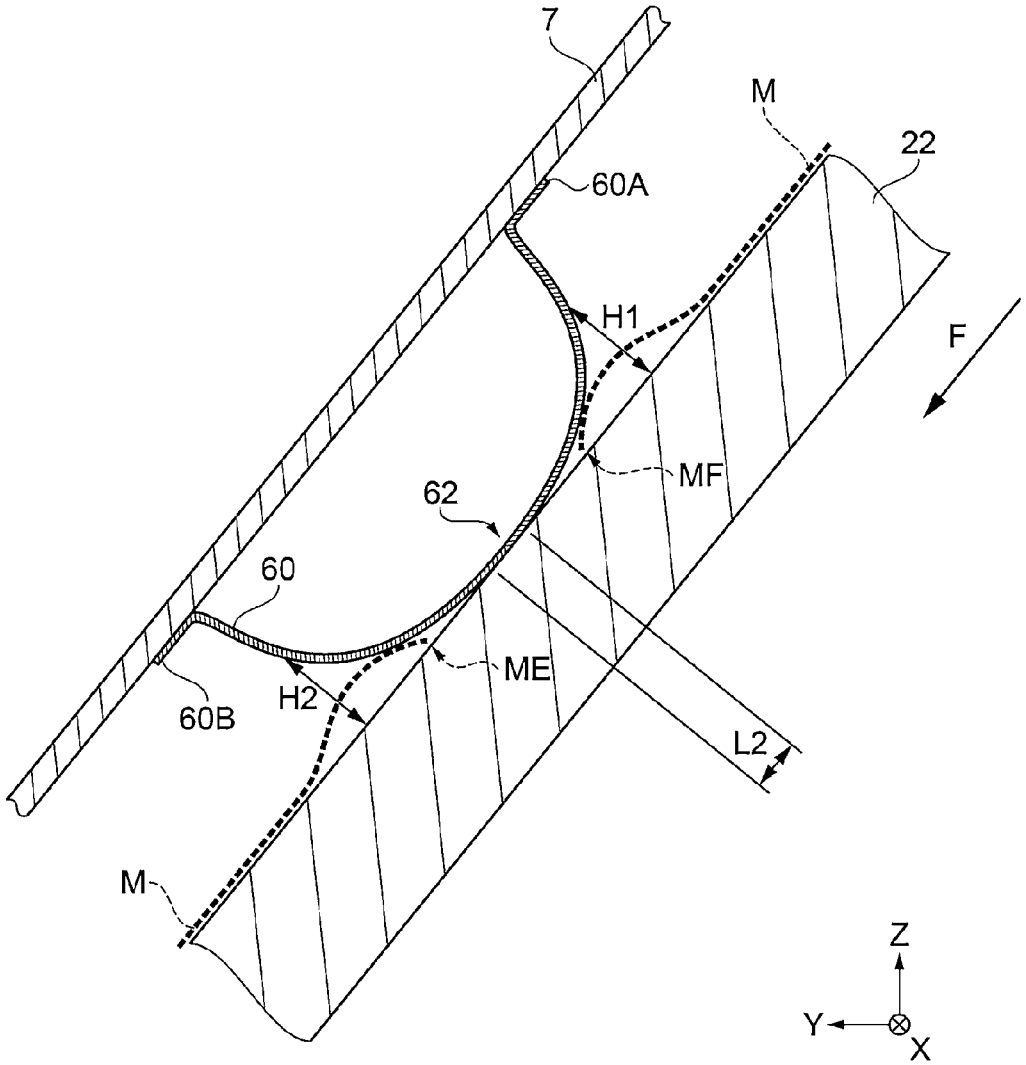
FIG. 5 is an enlarged view of a region that is surrounded by a broken line in FIG. 2.
Figure 6:
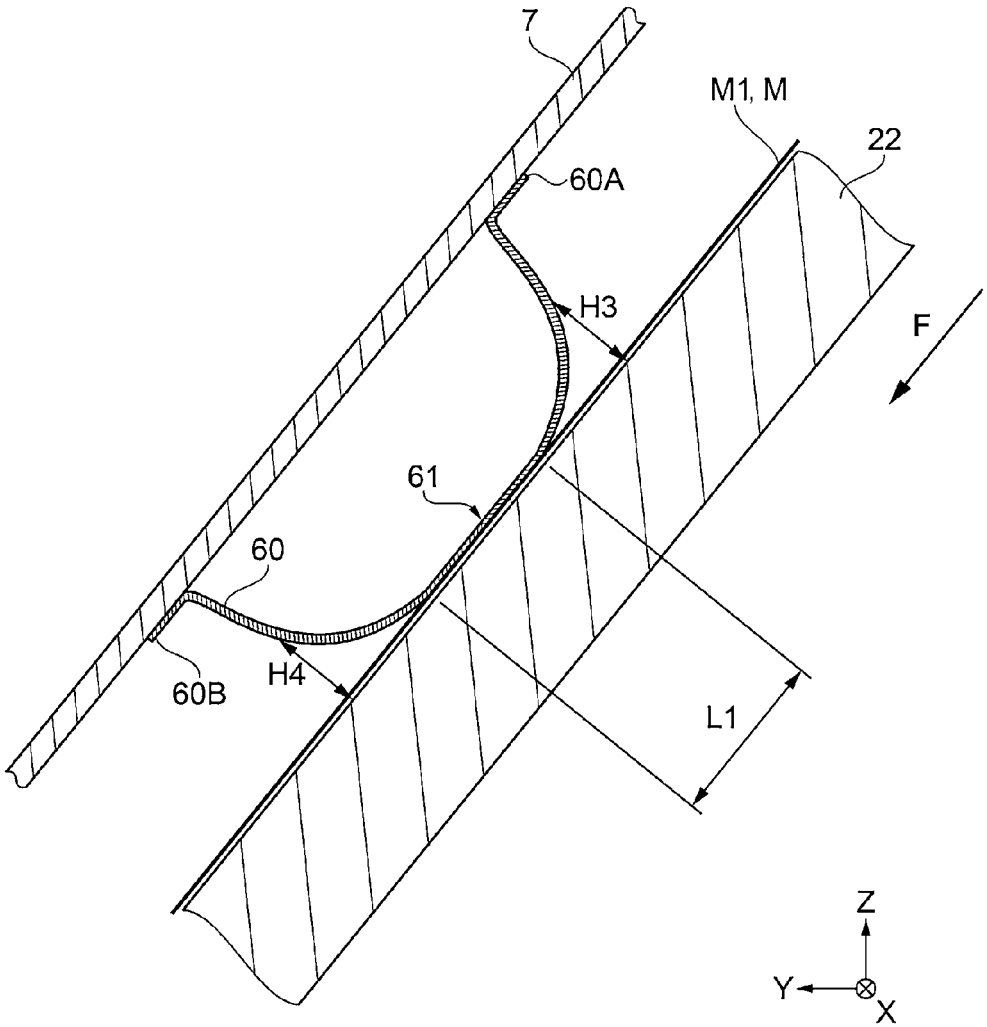
FIG. 6 is an enlarged view of the region that is surrounded by a broken line in FIG. 2.

FIGS. 3 and 4 are schematic views that show states of a removal portion viewed in an oblique direction (a direction that intersects the printing surface M1). FIGS. 5 and 6 are enlarged views of a region A that is surrounded by a broken line in FIG. 2, and are schematic views that show states of the removal portion. To explain in more detail, FIGS. 3 and 5 are schematic views that show states of the removal portion 60 in a case in which the medium M is not transported on the medium support portion 22. FIGS. 4 and 6 are schematic views that show states of the removal portion 60 in a case in which the medium M is transported on the medium support portion 22.

Additionally, in FIGS. 3 to 6, the illustration of constituent elements that are not required in the description is omitted.

As shown in FIG. 3, in a case in which the medium M is not transported on the medium support portion 22, the removal portion 60 has a U-shaped cross-section that extends in the direction that intersects the transport direction F (the X direction). The removal portion 60 is disposed so as to come into contact with the medium support portion 22. In a case in which the medium M is not supported by the medium support portion 22, among sections of the removal portion 60, a shaded section in the drawing is a section (a second contact portion 62) that comes into contact with the medium support portion 22. The second contact portion 62 extends in the direction (the X direction) that intersects the transport direction F.

As shown in FIG. 5, in the removal portion 60, both end portions (ends 60A and 60B) are fixed to the fixing portion 7 via an adhesive sheet (not illustrated in the drawings). That is, the removal portion 60 includes the one end 60A that is fixed to the fixing portion 7, and the other end 60B that is fixed to the fixing portion 7, and the one end 60A and the other end 60B are separated from one another. In addition, the end 60A is disposed further on the upstream side in the transport direction F than the end 60B.

In this manner, the removal portion 60 is fixed so that the position thereof does not change in both end portions (the ends 60A and 60B), and can be displaced between the end 60A and the end 60B.

There is a gap between the ends 60A and 60B of the removal portion 60 and the fixing portion 7, and even in a case in which the ends 60A and 60B of the removal portion 60 are not bonded to the fixing portion 7, as long as a configuration in which the end portions of the removal portion 60 are fixed to the fixing portion 7 so that it is not possible for the positions of the ends 60A and 60B of the removal portion 60 to change is used, the configuration is in the technical range of application of the present application.

Furthermore, even if there is a gap between the ends 60A and 60B of the removal portion 60 and the fixing portion 7, and the ends 60A and 60B of the removal portion 60 can be displaced by an external force, as long as a configuration in which there are sections that are fixed to the fixing portion 7 at the end portions of the removal portion 60 is used, the configuration is in the technical range of application of the present application.

The removal portion 60 is configured by a member (for example, a non-woven fabric) that has a flexible property. Therefore, the section between the end 60A and the end 60B of the removal portion 60 deform in the gravity direction due to the tare weight thereof, and come into contact with the medium support portion 22 as a result of hanging over on the side of the medium support portion 22. Among sections of the removal portion 60, a section that comes into contact with the medium support portion 22 is the second contact portion 62, and the length in the transport direction F of the second contact portion 62 is L2.

The removal portion 60 comes into contact with the medium support portion 22 in the second contact portion 62, and is spatially separated from the medium support portion 22 in both a section further on the upstream side in the transport direction F than the second contact portion 62 and a section further on the downstream side in the transport direction F than the second contact portion 62.

An interval H1 between the removal portion 60 and the medium support portion 22 becomes wider in tandem with progression toward the direction opposite to the transport direction F on the upstream side in the transport direction F of the second contact portion 62. That is, the removal portion 60 is disposed so that the interval H1 from the medium support portion 22 becomes wider in tandem with progression toward the direction opposite to the transport direction F.

An interval H2 between the removal portion 60 and the medium support portion 22 becomes wider in tandem with progression toward the transport direction F on the downstream side in the transport direction F of the second contact portion 62. That is, the removal portion 60 is disposed so that the interval H2 from the medium support portion 22 becomes wider in tandem with progression toward the transport direction F.

In the above-mentioned manner, the medium M is unwound from the roll body R, around which the medium M is wound in cylindrical form, and is fed out to the medium support portion 22 from the setting portion 20. When fed out to the medium support portion 22 from the setting portion 20, the medium M has an influence on the shape (curling) of the roll body R, around which the medium M is wound in cylindrical form, and it is likely that the medium M will warp in a direction that rises from the medium support portion 22 due to the curling. Furthermore, in a case in which the medium M is configured by a hard material or a thick material, the influence on curling is greater than in a case in which the medium M is configured by a soft material or a thin material, and therefore, it is likely that the medium M will warp in a direction that rises from the medium support portion 22.

The interval H1 between the removal portion 60 and the medium support portion 22 becomes wider in tandem with progression toward the direction opposite to the transport direction F on the upstream side in the transport direction F of the second contact portion 62, becomes narrower on a near side to the second contact portion 62 and becomes wider on a far side from the second contact portion 62. The medium M unwound from the roll body R is fed out to the side of the transport portion 30 by passing through a section in which the interval between the removal portion 60 and the medium support portion 22 is wide and a section in which the interval between the removal portion 60 and the medium support portion 22 is narrow in order.

In the present embodiment, since the interval H1 between the removal portion 60 and the medium support portion 22 becomes wider on a side at which a tip end MF of the medium M is received, even in a case in which the tip end MF of the medium M rises from the medium support portion 22 due to curling of the medium M as shown by the broken line in the drawing, since the tip end MF of the medium M is received in the section (on the far side from the second contact portion 62) in which the interval H1 between the removal portion 60 and the medium support portion 22 is wide and is guided by the removal portion 60 to the section (the near side to the second contact portion 62) in which the interval H1 between the removal portion 60 and the medium support portion 22 is narrow, it is unlikely that a transport fault of the medium M will occur.

If the tip end MF of the medium M rises from the medium support portion 22 due to curling of the medium M, in a case in which the interval H1 between the removal portion 60 and the medium support portion 22 is narrow on the side at which the tip end MF of the medium M is received, it is unlikely that the tip end MF of the medium M will be received between the removal portion 60 and the medium support portion 22, and therefore, it is likely that a transport fault such as a jam, for example, will occur as a result of the tip end MF of the medium M being pushed back in the direction opposite to the transport direction F by the removal portion 60.

Furthermore, in the printing apparatus 10, there are cases in which the medium M is rewound to the side of the setting portion 20 from the side of the transport portion 30.

For example, in a case in which the medium M is single sheet paper and the medium M is rewound to the side of the setting portion 20 from the side of the transport portion 30, since the interval H2 between the removal portion 60 and the medium support portion 22 becomes wider in tandem with progression toward the transport direction F on the downstream side in the transport direction F of the second contact portion 62, and therefore, becomes wider on a side (the far side from the second contact portion 62) at which the medium M is received, even in a case in which a trailing end ME of the medium M rises from the medium support portion 22, since the trailing end ME of the medium M is received in the section in which the interval H2 between the removal portion 60 and the medium support portion 22 is wide and is guided by the removal portion 60 to the section (the near side to the second contact portion 62) in which the interval H2 between the removal portion 60 and the medium support portion 22 is narrow, it is unlikely that a transport fault of the medium M will occur.

Accordingly, it is preferable that the interval H1 between the removal portion 60 and the medium support portion 22 become wider in tandem with progression toward the direction opposite to the transport direction F on the upstream side in the transport direction F of the second contact portion 62, and that the interval H2 between the removal portion 60 and the medium support portion 22 become wider in tandem with progression toward the transport direction F on the downstream side in the transport direction F of the second contact portion 62.

As shown in FIG. 4, in a case in which the medium M is transported on the medium support portion 22, the removal portion 60 is disposed so as to come into contact with either the medium support portion 22 or the medium M. In addition, a section in which the removal portion 60 comes into contact with either the medium support portion 22 or the medium M is shaded in the drawing. Among section of the removal portion 60, the section that comes into contact with the medium M is a first contact portion 61, which comes into contact with the printing surface M1 in a case in which the medium M is supported by the medium support portion 22. The first contact portion 61 extends in the direction (the X direction) that intersects the transport direction F.

The medium M is disposed on the inner side of the removal portion 60, and the length in the X direction of the removal portion 60 is longer than the length in the X direction of the medium M. The removal portion 60 comes into contact with the printing surface M1 of the medium M over a wide range in the width direction (the X direction) of the medium M. Since the removal portion 60 comes into contact with the printing surface M1 of the medium M over a wide range in the width direction of the medium M, it is possible to remove foreign matter adhered to the printing surface M1 of the medium M by transporting the medium M in the transport direction F.

Since the removal portion 60 is disposed on the inner side of the medium support portion 22 and the medium M is disposed on the inner side of the removal portion 60, among sections of the removal portion 60, sections (second contact portions 62) that come into contact with the medium support portion 22 are disposed at both ends of a section (the first contact portion 61) in which the removal portion 60 comes into contact with the printing surface M1 of the medium M. A second contact portion 62, the first contact portion 61, and a second contact portion 62 are disposed in order in the direction (the X direction) that intersects the transport direction F.

When the medium M is transported in the transport direction F, an external force in the transport direction F acts on the removal portion 60 from the medium M at the first contact portion 61, and the first contact portion 61 is pulled in the transport direction F.

Furthermore, a force (drag) that resists the external force in the transport direction F acts on the medium M from the removal portion 60. With respect to foreign matter adhered to the printing surface M1 of the medium M, the same drag (a force in a direction opposite to the transport direction F) also acts on the foreign matter from the removal portion 60, and the foreign matter adhered to the printing surface M1 of the medium M is removed by the removal portion 60.

Since the medium support portion 22 is stationary, the external force does not act on the removal portion 60 from the medium support portion 22 in the second contact portions 62. The second contact portions 62 seek to remain in the same position as a result of a friction force between the removal portion 60 and the medium support portion 22.

Therefore, when the medium M is transported in the transport direction F, since the first contact portion 61 is pulled in the transport direction F by the medium M and the second contact portions 62 seek to remain in the same position as a result of the friction force with the medium support portion 22, the first contact portion 61 deforms in a manner that hangs over in the transport direction F from the second contact portions 62, and the shape of the removal portion 60 becomes irregular in the vicinity of the boundaries of the first contact portion 61 and the second contact portions 62.

Furthermore, the state of outer surface uneven portions of the removal portion 60 and the medium support portion 22, and the state of the displacement of the removal portion 60 have an influence, and the influence of the friction force between the second contact portions 62 and the medium support portion 22 has a tendency to become more pronounced when a contact area of the second contact portions 62 with the medium support portion 22 becomes wider.

From this point onwards, the shape of the removal portion 60 becoming irregular in the vicinity of the boundaries of the first contact portion 61 and the second contact portions 62 will be referred to as boundary vicinity shape irregularity. In a case in which the boundary vicinity shape irregularity is extensive, it is unlikely that the removal portion 60 will stably come into contact with the medium M in a uniform manner in the vicinity of the boundaries of the first contact portion 61 and the second contact portion 62, and therefore, it is unlikely that foreign matter adhered to the printing surface M1 of the medium M will be stably removed in a uniform manner.

For example, in a case in which the length in the X direction of the medium M is equal to the length in the X direction of the removal portion 60 and there are not second contact portions 62, since the friction force with the medium support portion 22 does not act, the boundary vicinity shape irregularity does not occur, and the removal portion 60 can stably remove foreign matter in a uniform manner over a wide range of the printing surface M1 of the medium M.

However, when a difference between the length in the X direction of the removal portion 60 and the length in the X direction of the medium M is too great and the second contact portions 62 are too wide with respect to the first contact portion 61, the influence of the friction force between the removal portion 60 and the medium support portion 22 at the second contact portions 62 is strong, the boundary vicinity shape irregularity is extensive, and therefore, it is unlikely that foreign matter adhered to the printing surface M1 of the medium M will be stably removed in a uniform manner.

Furthermore, when the influence of the friction force between the removal portion 60 and the medium support portion 22 is strong at the second contact portions 62, transport of the medium M is blocked, and it is likely that a transport defect such as a jam will occur.

On the other hand, in a case in which the difference between the length in the X direction of the removal portion 60 and the length in the X direction of the medium M is small and the second contact portions 62 are not wide enough with respect to the first contact portion 61, the influence of the friction force between the removal portion 60 and the medium support portion 22 at the second contact portions 62 is weak, the boundary vicinity shape irregularity is negligible, and therefore, it is likely that foreign matter adhered to the printing surface M1 of the medium M will be stably removed in a uniform manner. Furthermore, it is also unlikely that transport of the medium M will be blocked.

Therefore, it is preferable that the difference between the length in the X direction of the removal portion 60 and the length in the X direction of the medium M be small. That is, it is preferable to use a removal portion 60 in which the length in the X direction is long for a medium M in which the length in the X direction is long, and to use a removal portion 60 in which the length in the X direction is short for a medium M in which the length in the X direction is short.

In the present embodiment, in a case of printing on media in which the length in the X direction differs greatly, a removal portion 60 in which the length in the X direction is long is used for a medium M in which the length in the X direction is long, and to use a removal portion 60 in which the length in the X direction is short is used for a medium M in which the length in the X direction is short. That is, in a case of printing on media in which the length in the X direction differs greatly, removal portions 60 of suitable lengths for the media are interchanged.

As shown in FIG. 6, when the medium M is transported on the medium support portion 22, since the printing surface M1 of the medium M is disposed further on a near side to the fixing portion 7 than the upper surface (the surface that supports the medium M) of the medium support portion 22, the removal portion 60 deforms more on the side (the side that comes into contact with the medium M) of the first contact portion 61 than on the side of the second contact portions 62 (the sides that come into contact with the medium support portion 22). Therefore, the length L1 in the transport direction F of the first contact portion 61 is greater than the length L2 in the transport direction F of the second contact portions 62.

In the above-mentioned manner, foreign matter adhered to the printing surface M1 of the medium M is removed as a result of the removal portion 60 causing a force in the direction opposite to the transport direction F to act on foreign matter adhered to the printing surface M1 of the medium M. Since the length L1 in the transport direction F of the first contact portion 61 is greater than the length L2 in the transport direction F of the second contact portions 62, the force in the direction opposite to the transport direction F, which removes foreign matter, acts for longer, and foreign matter adhered to the printing surface M1 of the medium M is removed more forcibly.

The removal portion 60 is spatially separated from the medium support portion 22 at both a section further on the upstream side in the transport direction F than the first contact portion 61 and a section further on the downstream side in the transport direction F than the first contact portion 61.

An interval H3 between the removal portion 60 and the medium support portion 22 becomes wider in tandem with progression toward the direction opposite to the transport direction F on the upstream side in the transport direction F of the first contact portion 61. That is, the removal portion 60 is disposed so that the interval H3 from the medium support portion 22 becomes wider in tandem with progression toward the direction opposite to the transport direction F.

An interval H4 between the removal portion 60 and the medium support portion 22 becomes wider in tandem with progression toward the transport direction F on the downstream side in the transport direction F of the first contact portion 61. That is, the removal portion 60 is disposed so that the interval H4 from the medium support portion 22 becomes wider in tandem with progression toward the transport direction F.

Figure 7:
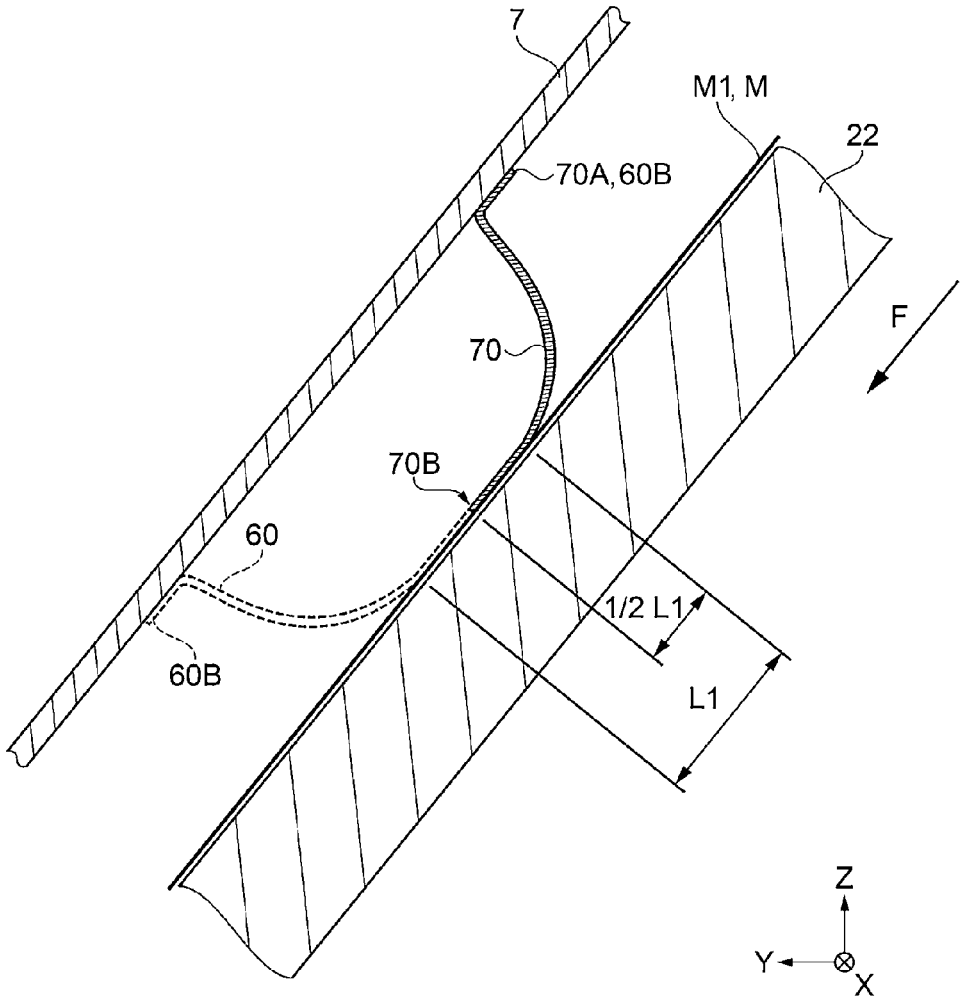
FIG. 7 is a schematic view that shows a state of a removal portion of a comparative example.
Figure 8:
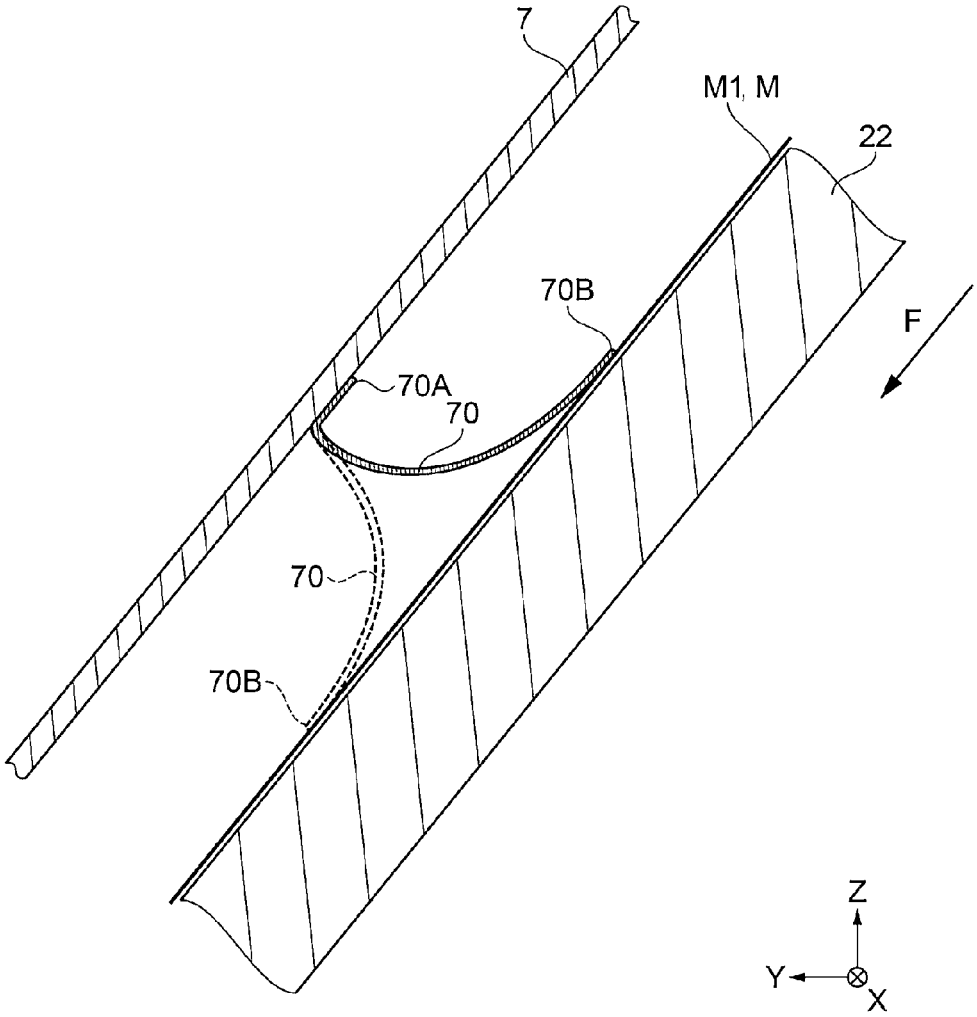
FIG. 8 is a schematic view that shows a state of the removal portion of the comparative example.

FIGS. 7 and 8 are views that correspond to FIG. 6, and are schematic views that show states of a removal portion of a comparative example. In FIG. 7, a removal portion 70 of the comparative example is shown by using a solid line, and the removal portion 60 of the present embodiment is shown by using a broken line. In FIG. 8, the removal portion 70 of the comparative example is shown by using a solid line and a broken line.

Additionally, the length in the transport direction F of the removal portion 70 of the comparative example is half that of the removal portion 60 of the present embodiment, one end 70A is fixed to the fixing portion 7, and another end 70B comes into contact with the medium M.

As shown in FIG. 7, the end 70B of the removal portion 70 is not fixed, and is capable of moving. Since the removal portion 70 is configured by the same material as that of the removal portion 60 of the present embodiment, the removal portion 70 has the same shape as the removal portion 60 of the present embodiment on the upstream side in the transport direction F of the end 70B. That is, the removal portion 70 has a shape in which the interval with the medium support portion 22 becomes wider in tandem with progression toward the direction opposite to the transport direction F on the upstream side in the transport direction F of the end 70B.

Since the length in the transport direction F of the removal portion 70 is half that of the removal portion 60 of the present embodiment, the length in the transport direction F of a section in which the removal portion 70 comes into contact with the medium M is half that of the length L1 in the transport direction F of the section that comes into contact with the medium M among sections of the removal portion 60 of the present embodiment. That is, the surface area of the section that comes into contact with the medium M among sections of the removal portion 70 is half that of the surface area of the section that comes into contact with the medium M among sections of the removal portion 60 of the present embodiment.

A state of the removal portion 70 in a case in which the medium M is rewound to the setting portion 20 is illustrated in FIG. 8.

As shown in FIG. 8, in a case in which the medium M is rewound to the setting portion 20, that is, in a case in which the medium M is transported in the direction opposite to the transport direction F, the removal portion 70 is pulled in the direction opposite to the transport direction F by a friction force with the medium M. Since the end 70B of the removal portion 70 is capable of moving, the end 70B of the removal portion 70 moves in the direction opposite to the transport direction F, and the shape of the removal portion 70 changes from the state shown by the broken line in the drawing to the state shown by the solid line in the drawing. That is, the removal portion 70 changes from a shape (the shape shown by the broken line in the drawing) in which a section spatially separated from the medium support portion 22 and a section that comes into contact with the medium support portion 22 are disposed in order along the transport direction F to a shape (the shape shown by the solid line in the drawing) in which a section that comes into contact with the medium support portion 22 and a section spatially separated from the medium support portion 22 are disposed in order in the transport direction F.

In a case in which the medium M is transported in the transport direction F, when the removal portion 70 has the shape shown by the broken line in the drawing, since it is possible to receive the medium M in a section in which the removal portion 70 and the medium support portion 22 are spatially separated, it is unlikely that the transport of the medium M will be blocked. However, when the removal portion 70 has the shape shown by the solid line in the drawing, since it is unlikely that the medium M will be received in a section in which the interval between the removal portion 70 and the medium support portion 22 is narrow, the tip end MF of the medium M (refer to FIG. 5) is pushed back in the direction opposite to the transport direction F by the removal portion 70, and therefore, it is likely that a transport fault such as a jam will occur.

Furthermore, when the length in the transport direction F of the removal portion 70 is great, the surface area of the section that comes into contact with the medium M among sections of the removal portion 70 is wide, and therefore, it is likely that the removal portion 70 will remove foreign matter adhered to the printing surface M1 of the medium M. However, when the length in the transport direction F of the removal portion 70 is great, the end 70B of the removal portion 70 moves greatly, and therefore, there is a concern that a defect such as twisting or flexing, for example, will occur. Therefore, in the removal portion 70 of the comparative example, it is unlikely that the length in the transport direction F of the removal portion 70 will be great.

In the removal portion 60 of the present embodiment, since both ends (the ends 60A and 60B) are fixed to the fixing portion 7, the shape thereof does not change in a case in which the medium M is fed out in the transport direction F or in a case in which the medium M is rewound in the direction opposite to the transport direction F, and therefore, it is possible to retain the shape in which it is unlikely that a transport defect of the medium M will occur.

Furthermore, since both ends (the ends 60A and 60B) are fixed to the fixing portion 7, it is unlikely that a defect such as twisting or flexing will occur even if the length in the transport direction F of the removal portion 60 is great. Therefore, it is possible to set the length in the transport direction F of the removal portion 60 of the present embodiment to be greater than that of the removal portion 70 of the comparative example, and therefore, it is possible to forcibly remove foreign matter adhered to the printing surface M1 of the medium M.

The removal portion 60 of the present embodiment is an aggregate of fibers that has a flexible property. To explain in more detail, the removal portion 60 is a non-woven fabric in which fibers are partially bonded. The fibers that configure the removal portion 60 can use a synthetic fiber such as polyester fiber, a polyamide fiber, or a polyolefin fiber, a semi-synthetic fiber such as an acetate, a regenerated fiber such as a cupra or a rayon, or a natural fiber such as cotton.

For example, the removal portion 60 may be a felt configured in a cloth form by entwining fibers. For example, the removal portion 60 may be a cloth formed by weaving or knitting fibers.

When the removal portion 60 is configured by an aggregate of a multitude of fibers, it is possible to form a multitude of spaces (hollow cavities) in the inner portion thereof. When spaces are formed in the inner portion of the removal portion 60, more foreign matter is trapped (accumulated) in the inner portion of the removal portion 60 than in a case in which spaces are not formed in the inner portion of the removal portion 60, and therefore, it is possible to trap more foreign matter. Accordingly, it is possible to enhance the foreign matter trapping performance of the removal portion 60 by forming spaces in the inner portion of the removal portion 60.

For example, if the removal portion 60 is configured by a brush, in comparison with a case in which the removal portion 60 is configured by an aggregate of fibers, the spaces of the inner portion of the brush are too wide, and therefore, it is unlikely that foreign matter will be secured in the inner portion of the brush. For example, there is a concern that foreign matter removed (scraped away) by the brush will become adhered to the printing surface M1 of the medium M again as a result of being scattered due to passing through the inner portion of the brush.

In the present embodiment, since foreign matter removed by the removal portion 60 is retained in the spaces in the inner portion of the removal portion 60, it is possible to suppress the concern that the foreign matter will become adhered to the printing surface M1 of the medium M again as a result of being scattered.

Additionally, in order to prevent the foreign matter trapping performance of the removal portion 60 from deteriorating, it is preferable that foreign matter trapped by the removal portion 60 be taken away at regular intervals by using a cleaning member (not illustrated in the drawings). For example, it is possible to easily take away the foreign matter trapped by the removal portion 60 by transporting adhesive sheet in place of the medium M.

Embodiment 2

Figure 9:
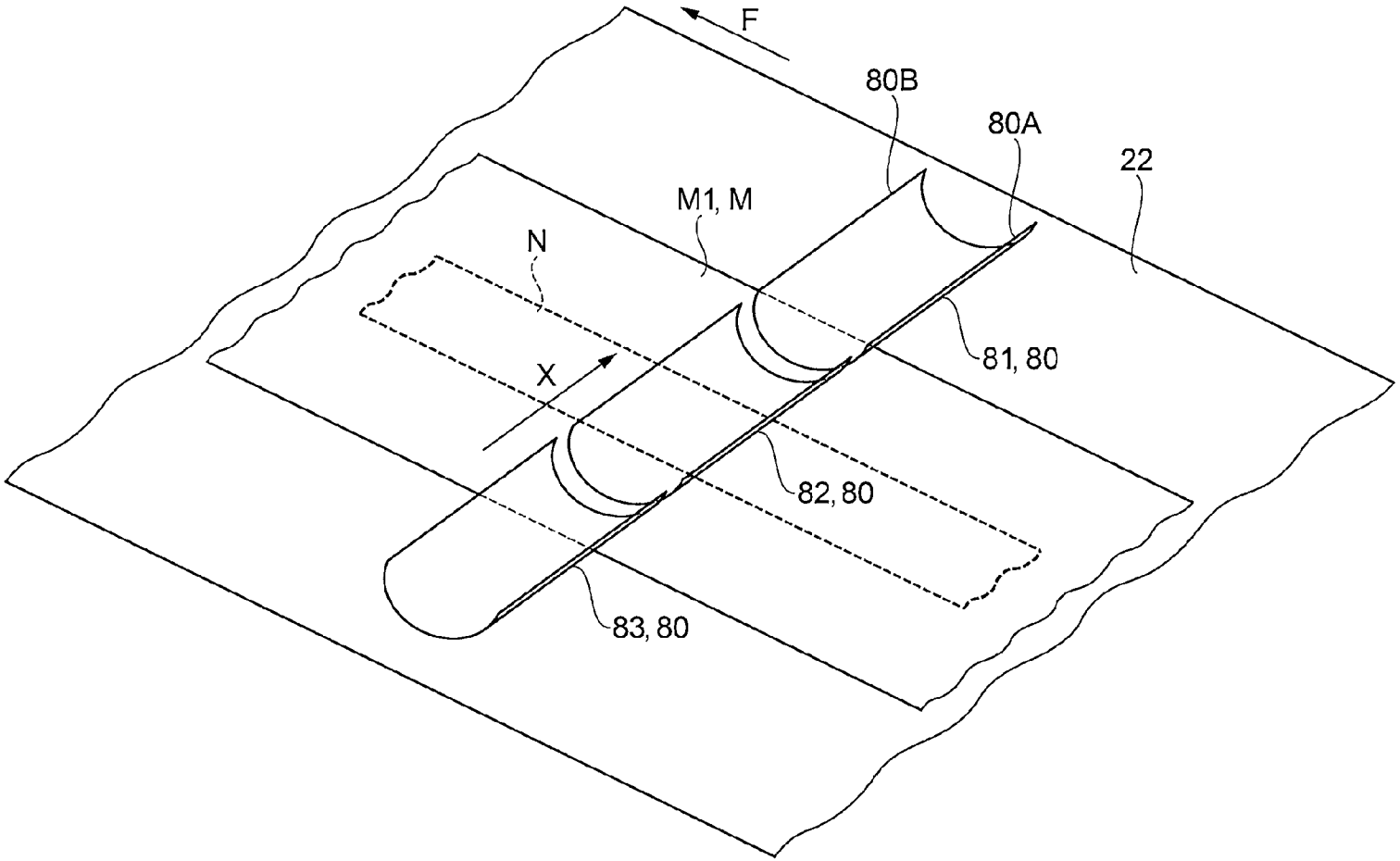
FIG. 9 is a schematic view that shows a state of a removal portion according to Embodiment 2.

FIG. 9 is a view that corresponds to FIG. 4, and is a schematic view that shows a state of a removal portion according to Embodiment 2. In FIG. 9, a medium N in which the length in the X direction is significantly shorter than that of the medium M is shown by using a broken line.

In the printing apparatus of the present embodiment, a removal portion 80 is divided into a plurality, the removal portion 60 in the printing apparatus 10 of Embodiment 1 is not divided into a plurality, and this feature is the difference between the present embodiment and Embodiment 1.

Hereinafter, a printer according to the present embodiment will be described with reference to FIG. 9 focusing on features that differ from the printing apparatus 10 according to Embodiment 1. In addition, constituent sites that are the same as those of Embodiment 1 will be given the same reference numerals, and overlapping descriptions thereof will be omitted.

As shown in FIG. 9, in the printing apparatus according to the present embodiment, the removal portion 80 is configured by a first removal portion 81, a second removal portion 82, and a third removal portion 83. The third removal portion 83, the second removal portion 82, and the first removal portion 81 are disposed in order in a direction (the X direction) that intersects the transport direction F.

That is, the removal portion 80 is divided into a plurality in the direction (the X direction) that intersects the transport direction F.

The respective lengths in the X direction of the removal portions 81, 82, and 83 are shorter than the length in the X direction of the removal portion 60 of Embodiment 1, and the removal portion 80 of the present embodiment has a configuration in which the removal portion 60 of Embodiment 1 is divided into three.

The removal portions 81, 82, and 83 respectively extend in the direction (the X direction) that intersects the transport direction F, and have U-shaped cross-sections. Both ends (ends 80A and 80B) of the removal portions 81, 82, and 83 are fixed to a fixing portion 7 (not illustrated in the drawings). In sections between the ends 80A and the ends 80B, the removal portions 81, 82, and 83 are hang over on the side of the medium support portion 22 as a result of deforming in the gravity direction due to the tare weight thereof.

Foreign matter adhered to the printing surface M1 of the medium M is removed as a result of all of the removal portions 80 (the first removal portion 81, the second removal portion 82 and the third removal portion 83) coming into contact with the printing surface M1 of the medium M.

For the medium N in which the length in the X direction is significantly shorter than that of the medium M, foreign matter adhered to the printing surface of the medium N is removed as a result of a portion of the removal portions 80 (a portion (the second removal portion 82) of the plurality of removal portions 81, 82, and 83) coming into contact with the printing surface of the medium N. That is, foreign matter adhered to the printing surface of the medium N is removed as a result of the second removal portion 82 coming into contact with the medium N without the first removal portion 81 and the third removal portion 83 coming into contact with the medium N.

In the above-mentioned manner, when a difference between the length in the X direction of the removal portion and the length in the X direction of the medium is too large, the boundary vicinity shape irregularity is extensive, and therefore, it is not possible to stably remove foreign matter adhered to the printing surface of the medium in a uniform manner, and furthermore, the transport of the medium M in the transport direction F is blocked.

Therefore, in Embodiment 1, it is necessary to perform replacement with a removal portion 60 of a suitable length for the medium N in which the length in the X direction is significantly shorter than that of the medium M.

In the present embodiment, a portion of the removal portions 80 (a portion (the second removal portion 82) of the plurality of removal portions 81, 82, and 83) comes into contact with the medium N, it is not necessary perform replacement with a removal portion 80 of a suitable length, and therefore, it is possible to stably remove foreign matter adhered to the printing surface of the medium N in a uniform manner while suppressing a transport fault of the medium N.

Accordingly, in the present embodiment, in comparison with Embodiment 1, it is not necessary to replace the removal portion 80, and therefore, it is possible to enhance the productivity of printing work.

Furthermore, when the removal portion 80 is divided into the plurality of removal portions 81, 82, and 83, in a case in which a defect such as scuffing or staining occurs in the removal portion 80, it is not necessary to replace the entire removal portion 80, and it is sufficient to replace the removal portion in which the defect such as scuffing or staining occurred only. For example, in a case in which a defect such as scuffing or staining occurs in the first removal portion 81, it is sufficient to replace the first removal portion 81 only.

Accordingly, a configuration (the configuration of the present embodiment) in which a portion of the removal portion that is divided into a plurality is replaced can suppress retention costs of the printing apparatus 10 in comparison with a configuration in which the entire removal portion is replaced (the configuration of Embodiment 1).

Additionally, in a case in which the removal portion has a configuration that is divided into a plurality, the number of divisions of the removal portion is not limited to three, the number of divisions of the removal portion may be more than three, or the number of removal portions the may be less than three.

Furthermore, in a case in which the removal portion has a configuration that is divided into a plurality, it is preferable that the removal portions divided into a plurality be displaced freely from one another. For example, a configuration in which the first removal portion 81 and the second removal portion 82 partially overlap, and in which displacement of the first removal portion 81 has an influence on displacement of the second removal portion 82 is not preferable since there is a concern that the boundary vicinity shape irregularity will be great. On the other hand, a configuration in which displacement of the first removal portion 81 does not have an influence on displacement of the second removal portion 82 is preferable since the concern that the boundary vicinity shape irregularity will be great is suppressed.

Therefore, in the present embodiment, the third removal portion 83, the second removal portion 82, and the first removal portion 81 are mutually spatially separated from one another as a result of being disposed in order in the direction (the X direction) that intersects the transport direction F so that the removal portions divided into a plurality are displaced freely.

Additionally, as long as the removal portions divided into a plurality are displaced freely, it is not necessary for the removal portions divided into a plurality to be disposed in a single direction, and for example, the removal portions may be disposed in a zigzag form. For example, a configuration in which the third removal portion 83, the second removal portion 82, and the first removal portion 81 are disposed in a zigzag form in the direction (the X direction) that intersects the transport direction F and in which portions thereof overlap in a case of viewing in the transport direction F may also be used.

Embodiment 3

Figure 10:
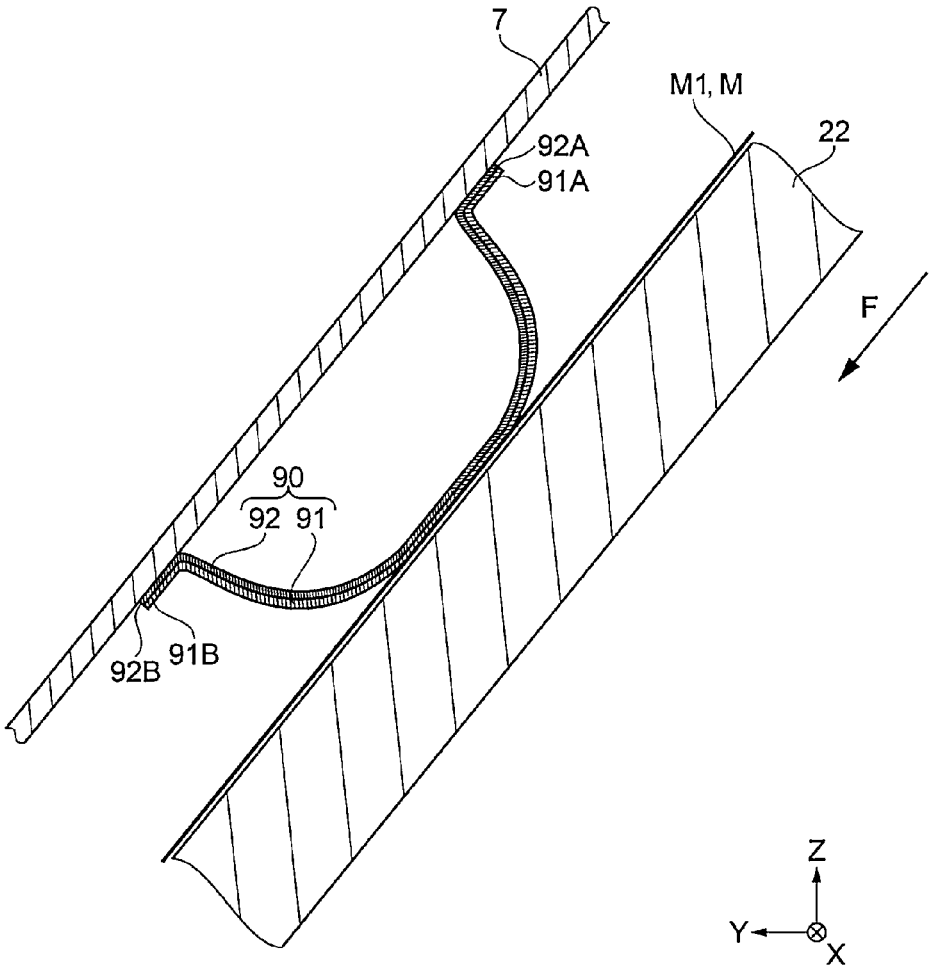
FIG. 10 is a schematic view that shows a state of a removal portion according to Embodiment 3.

FIG. 10 is a view that corresponds to FIG. 6, and is a schematic view that shows a state of a removal portion according to Embodiment 3.

In a printing apparatus according to the present embodiment, the configuration of a removal portion 90 differs from that of the printing apparatus 10 according to Embodiment 1, and other configurations are the same.

Hereinafter, a printing apparatus according to the present embodiment will be described with reference to FIG. 10 focusing on features that differ from the printing apparatus 10 according to Embodiment 1. In addition, constituent sites that are the same as those of Embodiment 1 will be given the same reference numerals, and overlapping descriptions thereof will be omitted.

As shown in FIG. 10, the removal portion 90 according to the present embodiment is configured by a first member 91 that is disposed on the side of the medium support portion 22, and a second member 92 that is disposed on the side (the side of the fixing portion 7) opposite to the medium support portion 22.

The first member 91 and the second member 92 have substantially the same shape, and overlap in a planar manner. That is, one end 91A of the first member 91 and one end 92A of the second member 92 are disposed in the same position, and another end 91B of the first member 91 and another end 92B of the second member 92 are disposed in the same position.

Additionally, the first member 91 and the second member 92 may have different shapes. For example, a configuration in which the first member 91 is larger than the second member 92, the one end 91A of the first member 91 is disposed on the upstream side in the transport direction F with respect to the one end 92A of the second member 92, and the other end 91B of the first member 91 is disposed on the downstream side in the transport direction F with respect to the other end 92B of the second member 92 may also be used. For example, a configuration in which the first member 91 is smaller than the second member 92, the one end 91A of the first member 91 is disposed on the downstream side in the transport direction F with respect to the one end 92A of the second member 92, and the other end 91B of the first member 91 is disposed on the upstream side in the transport direction F with respect to the other end 92B of the second member 92 may also be used.

The first member 91 and the second member 92 are bonded via an adhesive (not illustrated in the drawings). The one end 92A of the second member 92 and the other end 92B of the second member 92 are adhered (fixed) to the fixing portion 7 via an adhesive sheet (not illustrated in the drawings).

Additionally, the first member 91 and the second member 92 may be bonded to one another by using a method other than an adhesive, for example, heat welding.

The first member 91 is an aggregate of fibers that have a flexible property, and is configured by the same material as the removal portion 60 of Embodiment 1. To explain in more detail, the constituent material of the first member 91 is polyester, and the Young's modulus of the material that configures the first member 91 is approximately 3000 MPa.

The second member 92 is a film (a thin plate) configured by a material having higher rigidity than that of the first member 91. The material having higher rigidity than that of the first member 91 is a material that is unlikely to deform more than the first member 91, and is a material having a Young's modulus that is greater than that of the first member 91. To explain in more detail, the constituent material of the second member 92 is polyester terephthalate, and the Young's modulus of the material that configures the second member 92 is approximately 12000 MPa.

The constituent material of the side that comes into contact with the printing surface M1 of the medium M is the same as that of removal portion 90 (the first member 91) of the present embodiment and the removal portion 60 of Embodiment 1. In the present embodiment, the second member 92, which has higher rigidity than that of the first member 91, is added to the side (the side of the fixing portion 7) opposite to the side that comes into contact with the printing surface M1 of the medium M, and this feature is the feature that differs from Embodiment 1.

That is, in the removal portion 90 of the present embodiment, a section having higher rigidity than that of the removal portion 60 according to Embodiment 1 is added anew, and the rigidity is enhanced in comparison with that of Embodiment 1.

When the rigidity of the removal portion 90 is enhanced, it is possible to make the force with which the removal portion 90 presses the printing surface M1 of the medium M at the first contact portion 61 stronger. When the force of the removal portion 90 that presses the printing surface M1 of the medium M is strengthened, it is possible to more forcibly remove foreign matter adhered to the printing surface M1 of the medium M.

Additionally, when the force of the removal portion 90 that presses the printing surface M1 of the medium M becomes too strong, since there is a concern that wrinkling or scuffing of the medium M will occur as a result of there being adverse effects on the transport of the medium M, it is preferable that the force of the removal portion 90 that presses the printing surface M1 of the medium M not become too strong. Therefore, in the present embodiment, the thickness of the second member 92 is less than 1 mm, and therefore, the force of the removal portion 90 that presses the printing surface M1 of the medium M does not become too strong.

Embodiment 4

A removal portion 60 according to Embodiment 4 is configured by fibers that have a conductive property, and has a conductive property. That is, the removal portion according to the present embodiment is configured by a conductive member.

For example, the conductive member that configures the removal portion 60 includes a fiber composed of a polymer with a main chain having a structure in which double bonds and single bonds are alternately aligned, or a fiber composed of a conductive polymer such as a polypyrrole polymer, a polythiophene polymer, a polyaniline polymer, or a polyacetylene polymer.

In a case in which foreign matter becomes adhered to the printing surface M1 of the medium M due to an electrostatic force, it is likely that the electrostatic force will be weakened when the medium M is neutralized by the removal portion 60 and that foreign matter adhered to the printing surface M1 of the medium M will be removed. Accordingly, as a result of the removal portion 60 having a conductive property, it is likely that foreign matter adhered to the printing surface M1 of the medium M will be removed.

Additionally, the removal portion 60 may be an aggregate of a fiber that has a conductive property and a fiber that does not have a conductive property.

This application claims priority under 35 U.S.C. §119 to Japanese Patent Application No. 2016-077877, filed Apr. 8, 2016. The entire disclosure of Japanese Patent Application No. 2016-077877 is hereby incorporated herein by reference.

What is claimed is:

1. A printing apparatus comprising:

a printing portion that performs printing on a printing surface of a medium;

a transport portion that transports the medium in a transport direction and feeds out the medium to the printing portion;

a medium support portion that is disposed on an upstream side in the transport direction with respect to the printing portion and, among surfaces of the medium, supports a surface on a side opposite to the printing surface; and a removal portion that has a flexible property and includes a first contact portion, which comes into contact with the printing surface in a case in which the medium is supported by the medium support portion, wherein the removal portion is spatially separated from the medium support portion at both a section further on the upstream side in the transport direction than the first contact portion and a section further on the downstream side in the transport direction than the first contact portion, and wherein an interval between the removal portion and the medium support portion becomes wider in tandem with progression toward a direction opposite to the transport direction on the upstream side in the transport direction of the first contact portion, and becomes wider in tandem with progression toward the transport direction on the downstream side in the transport direction of the first contact portion.

2. The printing apparatus according to claim 1, wherein the first contact portion extends in a direction that intersects the transport direction.

3. The printing apparatus according to claim 1, further comprising:

a fixing portion that fixes the removal portion, wherein in a case in which the medium is not supported by the medium support portion, the removal portion blocks a gap between the fixing portion and the medium support portion by coming into contact with the medium support portion.

4. The printing apparatus according to claim 1, wherein a length in the transport direction of the first contact portion is greater than a length in the transport direction of a second contact portion in a case in which a section in which the removal portion comes into contact with the medium support portion is set as the second contact portion in a case in which the medium is not supported by the medium support portion.

5. The printing apparatus according to claim 1, wherein the removal portion is divided into a plurality in a direction that intersects the transport direction.

6. The printing apparatus according to claim 1, wherein the removal portion includes a first member that is disposed on a side of the medium support portion, and a second member that is disposed on a side opposite to the medium support portion, and wherein the rigidity of the second member is greater than that of the first member.

7. The printing apparatus according to claim 1, further comprising:

a fixing portion that fixes the removal portion, wherein the removal portion includes one end that is fixed to the fixing portion, and another end that is fixed to the fixing portion, and wherein the one end and the other end are separated from one another.

8. The printing apparatus according to claim 1, wherein the removal portion is configured by a conductive member.

9. The printing apparatus according to claim 1, wherein the transport portion includes a plurality of rollers, and wherein the removal portion is disposed further on the upstream side in the transport direction than a roller disposed furthest on the upstream side in the transport direction among the plurality of rollers.

10. The printing apparatus according to claim 1, further comprising:

a setting portion that feeds out the medium to the transport portion, wherein the removal portion is disposed between the setting portion and the transport portion.

* * * * *